US008448611B2

(12) United States Patent
Dean et al.

(10) Patent No.: US 8,448,611 B2
(45) Date of Patent: May 28, 2013

(54) DETONATION COMBUSTOR CLEANING DEVICE AND METHOD OF CLEANING A VESSEL WITH A DETONATION COMBUSTOR CLEANING DEVICE

(75) Inventors: Anthony John Dean, Scotia, NY (US); David Michael Chapin, Kansas City, MO (US); Donnell Eugene Crear, Glenville, NY (US)

(73) Assignee: General Electric Company, Schenectady, NY (US)

( * ) Notice: Subject to any disclaimer, the term of this patent is extended or adjusted under 35 U.S.C. 154(b) by 34 days.

(21) Appl. No.: 13/168,310

(22) Filed: Jun. 24, 2011

(65) Prior Publication Data

US 2011/0256487 A1 Oct. 20, 2011

Related U.S. Application Data

(63) Continuation of application No. 12/129,909, filed on May 30, 2008, now Pat. No. 7,987,821.

(51) Int. Cl.
*F22B 37/48* (2006.01)

(52) U.S. Cl.
USPC ..... 122/379; 122/396; 134/166 R; 134/22.12

(58) Field of Classification Search
USPC ..... 122/379, 390, 396; 134/22.12, 105, 134/166 R, 106, 198
See application file for complete search history.

(56) References Cited

U.S. PATENT DOCUMENTS

| | | | | |
|---|---|---|---|---|
| 2,877,781 | A | 3/1959 | Lipp et al. | |
| 6,408,759 | B1 | 6/2002 | Ewick et al. | |
| 6,684,823 | B1 | 2/2004 | Plavnik et al. | |
| 7,011,047 | B2 * | 3/2006 | Aarnio et al. | 122/379 |
| 7,360,508 | B2 * | 4/2008 | Habib et al. | 122/379 |
| 2002/0112638 | A1 * | 8/2002 | Zilka et al. | 102/307 |
| 2004/0031450 | A1 * | 2/2004 | Chandran et al. | 122/24 |
| 2005/0126594 | A1 * | 6/2005 | Chenevert et al. | 134/19 |
| 2008/0271685 | A1 * | 11/2008 | Lupkes et al. | 122/396 |
| 2009/0120336 | A1 | 5/2009 | Chapin et al. | |
| 2009/0320439 | A1 | 12/2009 | Chapin et al. | |
| 2011/0226284 | A1 * | 9/2011 | Taylor et al. | 134/19 |

FOREIGN PATENT DOCUMENTS

| | | |
|---|---|---|
| GB | 240557 | 6/2005 |
| SU | 1640512 | 4/1991 |

OTHER PUBLICATIONS

GB Search Report under Section 17 for Application No. GB0908579.6 dated Jul. 27, 2009.
English Translation of Chinese Office Action and Search Report for CN Application No. 200910145762.X, dated Aug. 15, 2012, pp. 1-5.

* cited by examiner

*Primary Examiner* — Gregory A Wilson
(74) *Attorney, Agent, or Firm* — Cantor Colburn LLP

(57) ABSTRACT

A detonation device cleaning system includes a vessel having a main body including an outer surface and an inner surface that collectively define an interior chamber. A detonation combustor cleaning device is mounted to the vessel. The detonation combustor cleaning device includes at least one combustion chamber that defines a combustion flow path. The at least one combustion chamber includes a deflection member arranged along the combustion flow path. An ignition device is operatively connected to the at least one combustion chamber. The ignition device is selectively activated to ignite fuel within the at least one combustion chamber to produce a shockwave that moves in a first direction along the combustion flow path, is redirected back along the flow path within the at least one combustion chamber, and passes into the interior chamber to dislodge particles clinging to the inner surface of the vessel.

20 Claims, 3 Drawing Sheets

DETONATION COMBUSTOR CLEANING DEVICE AND METHOD OF CLEANING A VESSEL WITH A DETONATION COMBUSTOR CLEANING DEVICE

CROSS-REFERENCE TO RELATED APPLICATIONS

This application is a continuation of U.S. Ser. No. 12/129,909, filed May 30, 2008, entitled "Detonation Combustor Cleaning Device and Method of Cleaning A Vessel with a Detonation Combustor Cleaning Device", the contents of which are incorporated herein by reference in its entirety.

BACKGROUND

The present disclosure relates to the art of vessel cleaning devices and, more particularly, to a detonation combustor cleaning device for dislodging debris from inner surfaces of vessels.

Industrial boilers operate by using a heat source to create steam from water or another working fluid, which can then be used to drive a turbine in order to supply power. Conventionally, the heat source is a combustor that burns a fuel in order to generate heat, which is then transferred into the working fluid via a heat exchanger, such as a fluid conducting tube or pipe. Burning fuel may generate residues that often are left behind forming a buildup on surfaces of associated ducting or heat exchanger. This buildup can lead to performance degrades related to an increase in pressure drop, reduced fuel efficiency, and damage to mechanical components. These performance degrades can eventually lead to costly planned or unplanned outages. Periodic removal or prevention of such buildup maintains the operational efficiency of such boiler systems. In the past, the buildup was removed by directing pressurized steam, water jets, acoustic waves, and mechanical hammering onto the inner surfaces of the combustor or heat exchanger. However, such systems are often times costly to maintain and not always effective. That is, the effectiveness of such devices will vary depending on location and use.

More recently, detonative combustion devices are used to remove the buildup. Detonative combustion devices that burn customer friendly fuels, such as natural gas and propane, tend to require large detonation chamber diameters and lengths, which, in turn, require a relatively large installation footprint. Moreover, in some cases, such detonation devices require oxygen enrichment in order to create the detonations. Flexible fuels, or fuels having a large detonation cell size and high direct initiation energy, such as natural gas and propane, do not burn properly in existing systems without the addition of some amount of pre oxygen. More specifically, when using flexible fuels in existing detonative combustions devices, flame propagation velocity is less than desired, resulting in little or no cleaning ability of the resulting combustion process.

BRIEF DESCRIPTION

In accordance with one aspect of an exemplary embodiment, a detonation device cleaning system includes a vessel having a main body including an outer surface and an inner surface that collectively define an interior chamber. A detonation combustor cleaning device is mounted to the vessel. The detonation combustor cleaning device includes at least one combustion chamber that defines a combustion flow path. The at least one combustion chamber includes a deflection member arranged along the combustion flow path. An ignition device is operatively connected to the at least one combustion chamber. The ignition device is selectively activated to ignite fuel within the at least one combustion chamber to produce a shockwave that moves in a first direction along the combustion flow path, is redirected back along the flow path within the at least one combustion chamber, and passes into the interior chamber to dislodge particles clinging to the inner surface of the vessel.

In accordance with another aspect of an exemplary embodiment, a detonation combustor cleaning device includes at least one combustion chamber that defines a combustion flow path. The at least one combustion chamber includes a deflection member arranged along the combustion flow path. An ignition device is operatively connected to the at least one combustion chamber. The ignition device is selectively activated to ignite fuel within the at least one combustion chamber to produce a shockwave that moves in a first direction along the combustion flow path, is redirected back along the flow path within the at least one combustion chamber, and passes into the interior chamber to dislodge particles clinging to the inner surface of the vessel.

In accordance with still another aspect of an exemplary embodiment, a method of cleaning a vessel with a detonation cleaning device includes receiving a flow of air and fuel into at least one combustion chamber having a combustion flow path, forming a shockwave within the combustion flow path though ignition of the air and fuel, accelerating the shockwave along the combustion flow path in a first direction, redirecting the shockwave within the combustion chamber back along the combustion flow path in a second direction, directing the shockwave into a vessel having a surface to be cleaned, and loosening debris from the surface to be cleaned as a result of impacts from the shockwave.

Additional features and advantages are realized through the techniques of exemplary embodiments of the invention. Other embodiments and aspects of the invention are described in detail herein and are considered a part of the claimed invention. For a better understanding of the invention with advantages and features thereof, refer to the description and to the drawings.

DETAILED DESCRIPTION

Figure 1:
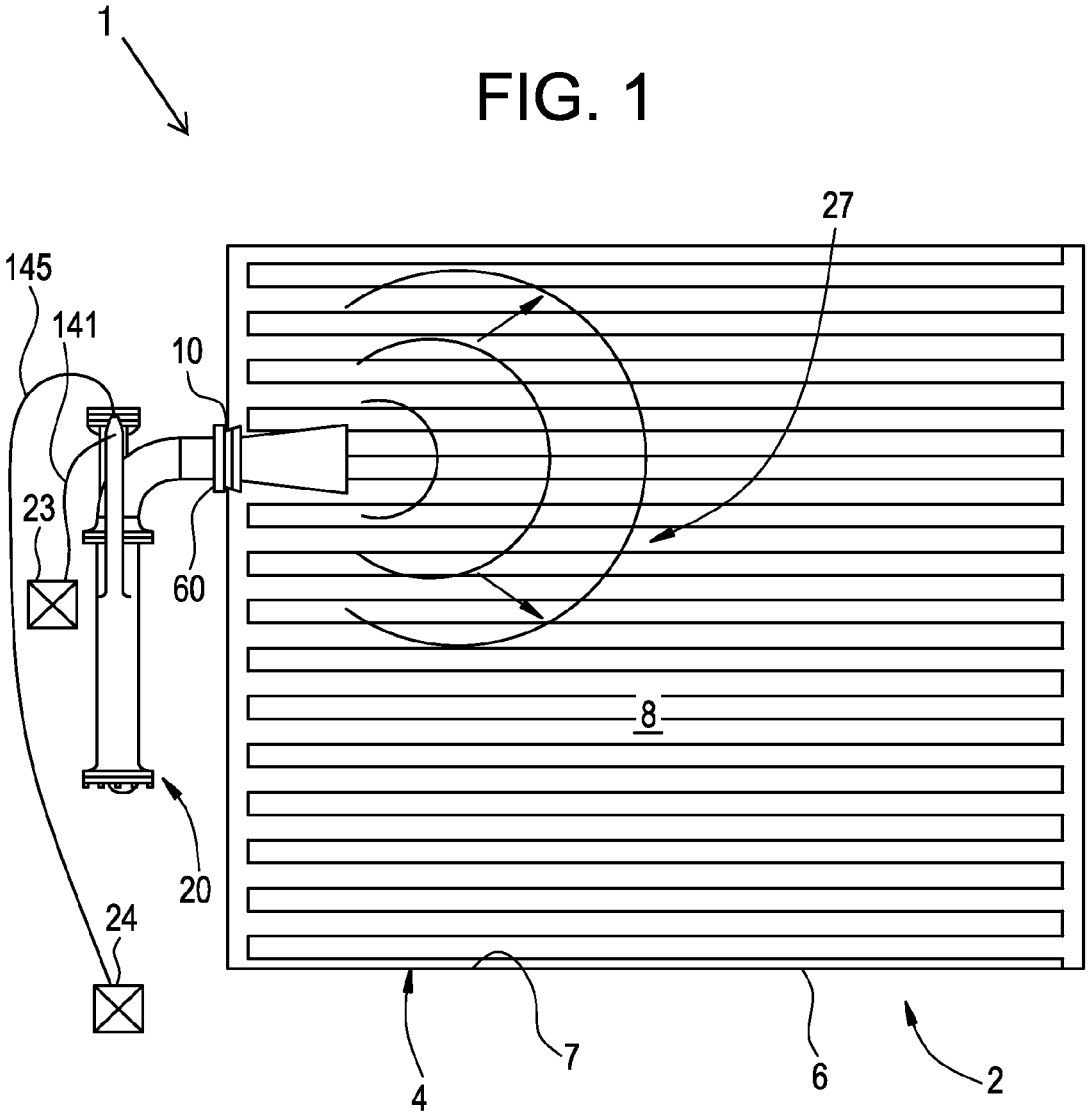
FIG. 1 is a top schematic view of an interior chamber of a vessel, shown in the form of an industrial boiler, having a detonation combustion cleaning device constructed in accordance with an exemplary embodiment of the invention.

Soot, ash, or other buildup on inner surfaces of industrial boilers or other vessels can cause efficiency losses. Examples of such efficiency losses include reduced heat transfer capability, reduced gas flow capability and reduced process "online" time. In the case of industrial boilers, the efficiency losses are often evidenced by an increase in exhaust gas temperature measured at a backend of a heat exchange process, as well as an increase in a fuel-burn rate necessary to maintain steam production and energy output. Traditionally, completely removing buildup from such fouled surfaces requires that the boiler be shut down during cleaning. Some online cleaning methods are able to extend boiler operation without localized cleaning. Cleaning while the boiler remains online generally leads to high maintenance costs, high operational costs and/or incomplete cleaning results.

In the systems and techniques according to exemplary embodiments of the invention, a combustion chamber or detonation combustor external to the boiler is used to generate a series of detonations or quasi-detonations that are directed into a portion of the boiler having accumulated build-up. High speed shock or sound waves having high pressure fluctuations travel through the portion of the boiler and loosen buildup from the surface. The buildup is carried away from the surfaces by gravity and/or gas flow, to a bottom portion of the boiler. The buildup is then removed from the boiler through hoppers, stacks or otherwise removed from the gas stream through environments control devices such as bag houses or electronic precipitators. As will be discussed below, the use of repeated detonations has advantages over traditional cleaning techniques, such as steam/air soot blowers or purely acoustic soot removal devices.

It is also desirable that a cleaning system for a boiler be able to operate to quickly remove buildups in order to minimize down-time for the boiler. In addition, it is desirable that the system be conveniently operable within a boiler environment, i.e. that it is able to physically fit within space restrictions necessary, able to reach portions of the boiler that require de-fouling, and that the detonation chamber does not interfere with boiler operation when the cleaning system is not in use. It is also desirable that the installation of such a cleaner not take up excessive floor space outside the boiler or require major modifications to the boiler for access. It is further desirable that the cleaning system be able to operate using a broad range of fuel types. A detonation combustor based cleaning system that can provide these and other features will be described in more detail below.

As used herein, the term "pulse detonation combustor" (PDC) will refer to a device or system that produces both a pressure rise and velocity increase from the detonation or quasi-detonation of a fuel and an oxidizer, and that can be operated in a repeating mode to produce multiple detonations or quasi-detonations within the device. A "detonation" is a supersonic combustion in which a shock wave is coupled to a combustion zone, and the shock is sustained by the energy release from the combustion zone, resulting in combustion products at a higher pressure than the combustion reactants. For simplicity, the term "detonation" as used herein will be meant to include both detonations and quasi-detonations. A "quasi-detonation" is a supersonic turbulent combustion process that produces a pressure rise and velocity increase higher than a pressure rise and velocity increase produced by a sub-sonic deflagration wave.

Exemplary PDCs, some of which will be discussed in further detail below, include an ignition device for igniting combustion of a fuel/oxidizer mixture, and a detonation chamber in which pressure wave fronts initiated by the combustion coalesce to produce a detonation wave. Each detonation or quasi-detonation is initiated either by an external ignition source, such as a spark discharge, laser pulse, heat source, or plasma igniter, or by gas dynamic processes such as shock focusing, auto ignition or an existing detonation wave from another source (cross-fire ignition). The detonation chamber geometry allows the pressure increase behind the detonation wave to drive the detonation wave and also to blow the combustion products themselves out an exhaust of the PDC.

Various chamber geometries can support detonation formation, including round chambers, tubes, resonating cavities and annular chambers. Such chambers may be of constant or varying cross-section, both in area and shape. Exemplary chambers include cylindrical tubes and tubes having polygonal cross-sections, such as, for example, hexagonal tubes. As used herein, "downstream" refers to a direction of flow of at least one of fuel and/or oxidizer.

With initial reference to FIG. 1, a detonation device cleaning system 1 includes a vessel, shown in the form of an industrial boiler is indicated generally at 2. Vessel 2 includes a main body 4 having an outer surface 6 and an inner surface 7 that defines an interior chamber 8. In the embodiment shown, vessel 2 includes a flange 10 that is provided on main body 4. Cleaning system 1 also includes a detonation combustor cleaning device 20 operatively connected to flange 10 and, as will become more fully evident below, an air source 23 and a fuel source 24. Detonation combustion cleaner 20 is selectively operated to direct a shockwave 27 onto inner surface 7 to loosen any build-up of debris.

Figure 2:
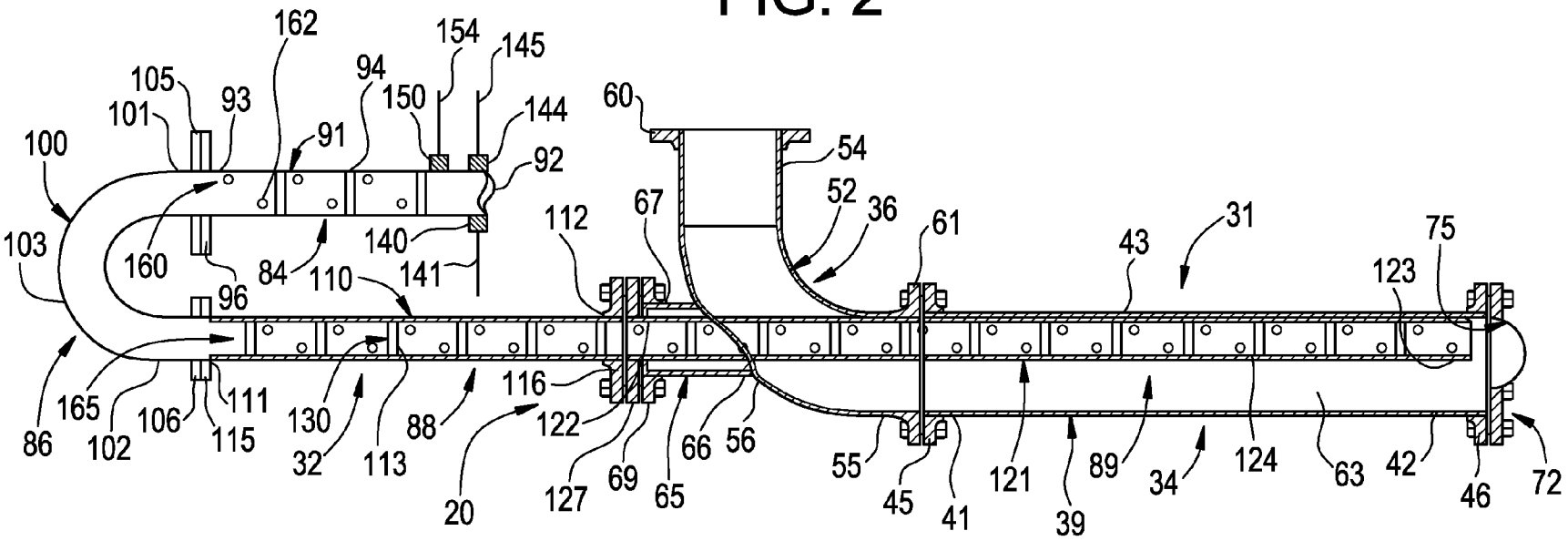
FIG. 2 is a cross-sectional schematic view of the detonation combustion cleaning device of FIG. 1.

As best shown in FIG. 2, detonation combustor cleaning device 20 includes a main or first combustion chamber 31 and an initiator tube or second combustion chamber 32. First combustion chamber 31 includes a first or substantially linear combustion portion 34 that extends to a second or arcuate combustion portion 36. Substantially linear combustion portion 34 includes a substantially linear main body portion 39 having a first end portion 41 that extends to a second end portion 42 through an intermediate portion 43. First end portion 41 is provided with a flange 45. Similarly, second end portion 42 is provided with a flange 46. Arcuate combustion portion 36 includes an arcuate main body portion 52 having a first end portion 54 that extends to a second end portion 55 through an arcuate intermediate portion 56. First end portion 54 is provided with a flange 60 that is connected to flange 10 on vessel 2 while second end portion 55 is provided with a flange 61 that is connected to flange 45, joining arcuate portion 36 to substantially linear portion 34. In this manner, linear combustion portion 34 and arcuate combustion portion 36 combine to define a first combustion flow path 63.

In addition, first combustion chamber 31 includes a connector portion 65 having a first end 66 that extends to a second end 67 that is provided with a flange 69. Flange 69, in a manner that will be described more fully below, serves as a connection point for second combustion chamber 32. First combustion chamber 31 is further shown to include a deflection member 72 having a deflection surface 75. In the exemplary embodiment shown, deflection surface 75 is curvilinear or concave in shape.

Further shown in FIG. 2, second combustion chamber 32 includes a first or substantially linear combustion section 84 that extends to a second or curvilinear combustion section 86 that leads to a second substantially linear combustion section 88 before terminating in a third substantially linear combustion section 89. First combustion section 84 includes a main body section 91 having a first end section 92 that extends to a second end section 93 through an intermediate section 94. Second end section 93 is provided with a flange 96. Curvilinear combustion section 86 includes a curvilinear main body section 100 having a first end section 101 that extends to a second end section 102 through a curvilinear intermediate section 103. First end section 101 is provided with a flange 105 that is joined to flange 96, while second end section 102 is provided with a flange 106. In a manner similar to that described above, second substantially linear combustion section 88 includes a main body section 110 having a first end section 111 that extends to a second end section 112 through an intermediate section 113. First end section 111 is provided with a flange 115 that joins with flange 106 to connect second substantially linear combustion section 88 to curvilinear combustion section 86. In addition to flange 115 on first end section 111, second end section 112 is provided with a flange 116.

In a manner also similar to that described above, third substantially linear combustion section 89 includes a main body section 121 having a first end section 122 that extends to a second end section 123 through an intermediate section 124. First end section 122 is provided with a flange 127 that joins to flange 116 interconnecting second linear combustion section 88 and third linear combustion section 89. Actually, flange 127 is sandwiched between flange 69 provided on connector portion 65 and flange 116. First substantially linear combustion section 84 combines with curvilinear combustion section 86, second substantially linear combustion section 88 and third substantially linear combustion section 89 to form a second combustion flow path 130.

Second combustion chamber 32 is shown to include an air inlet 140 positioned at first end section 92 of first substantially linear combustion section 84. Air inlet 140 is connected to air source 23 via a conduit 141. A fuel inlet 144 is arranged approximate to air inlet 140. Fuel inlet 144 is fluidly connected to fuel source 24 via a conduit 145. In addition, second combustion chamber 32 is provided an ignition device or an igniter 150 that is arranged downstream of air inlet 140 and fuel inlet 144. Igniter 150 is operatively connected to a controller (not shown) via a lead 154.

Although not illustrated, such a controller may be used as is generally known in the art to control the timing and operation of various systems, such as the fuel valve and ignition source. As used herein, the term controller is not limited to just those integrated circuits generally referred to in the art as a controller, but broadly refers to a processor, a microprocessor, a microcontroller, a programmable logic controller, an application specific integrated circuit, and other programmable circuits suitable for such purposes.

In further accordance with the exemplary embodiment shown, second combustion chamber 32 is provided with a plurality of obstacles 160 arranged with a first substantially linear combustion section 84. Obstacles 160 are shown in the form of a plurality cylindrical protrusions, one of which is indicated at 162. In addition, a second plurality of obstacles 165 is provided within second substantially linear portion 88 and third substantially linear portion 89. Obstacles 160 and 165 are disposed at various locations along first substantially linear combustion portion 84 and second and third substantially linear combustion portions 88 and 89 respectively. That is, obstacles 160 and 165 are arranged at regular intervals with an angular off-set between adjacent obstacles. Obstacles 160 and 165 serve to accelerate a combustion front or shock wave, associated with the flame front, into a detonation or quasi-detonation prior to reaching second end section 123. Obstacles 160 and 165 are thermally integrated onto an internal wall portion (not separately labeled) of second combustion chamber 32. Such thermally integrated obstacles may be created in various ways. For example, obstacles may include features that are machined into the wall, formed integrally with the wall, by casting or forging, by (for example) or attached to the wall, for example, by welding. In general, a thermally integrated obstacle or other thermally integrated feature in sufficient contact with an internal wall portion of second combustion chamber 32 such that obstacles 160 and 165 exchange heat effectively with second combustion chamber 32.

Although described as cylindrical protrusions, it should be understood that obstacles 160 and 165 may take on a variety of forms such as, annular rings, partial protrusions, and the like. In addition, rather than being spaced equally as shown in FIG. 2, obstacles 160 and 165 may be placed with varying distances between adjacent obstacles. In any case, in the exemplary embodiment shown, obstacles 160 and 165 are formed having a width that is between about one-quarter and one-half of an inner diameter of second combustion chamber 32. A length of each of the plurality of obstacles 160 and 165 is about 1½ of an inner diameter of second combustion chamber 32 or greater.

Having described an overall structure of detonation combustion cleaning device 20, the general operation of detonation cleaning device 20 will be discussed with referenced to FIG. 2. In the section that follows, a single occurrence of a fuel fill phase, a combustion ignition, an acceleration of a flame front to detonation and a blow down and purge of combustion products will be referred to as a combustion cycle or detonation cycle. A portion of time that the cleaner system is active is referred to as a "cleaner operation". Time when vessel 2 is being actively used for its purpose will be referred to as "boiler operation". As noted above, vessel 2 need not be part of a boiler. However, for simplicity of reference the term "boiler operation" will be used to refer to the operation of any device being cleaned by detonation combustion device 20.

In particular, and as will be discussed more fully below, one advantage of detonation combustion cleaning device 20 described herein is that, unlike other detonation cleaning systems, there is no need to shut down the vessel or other device during cleaning. Specifically, it is possible for detonation combustion cleaning device 20 to operate during boiler operation. Detonation combustion cleaning device 20 need not be running continuously during boiler operation; however, by providing the flexibility to operate detonation combustion cleaning device 20 on a regular cycle during boiler operation an overall higher level of cleanliness can be maintained without significant down-time in boiler operation.

In the fill phase of the detonation cycle, air and fuel are introduced into second combustion chamber 32 via air inlet 140 and fuel inlet 145. The air and fuel pass into second combustion chamber 32 and mix to form a fuel/air mixture suitable for combustion within detonation combustion cleaning device 20. As more fuel and air are introduced and mixed, second combustion chamber 32 fills with the fuel/air mixture, flowing along the second combustion flow path 130 toward first combustion chamber 31. Air can be fed continuously into second combustion chamber 32 through air inlet 140 during cleaning operation. However, it may be desirable to use a valve to control reintroduction into second combustion chamber 32 by means of a controller in some embodiments. In addition, the ability to control airflow for times when detonation and combustion cleaning device 20 is not operating may also be desirable. In one exemplary embodiment, a controller (not shown) tracks an amount of time that fuel inlet 144 is open and, based upon a rate of air input to second combustion chamber 32, operate to close fuel inlet 144 once a sufficient amount of fuel has been added such that the fuel air mixture has filled a desired portion of combustion chambers 31 and 32.

Once a sufficient amount of air fuel mixture has been introduced, ignition device 150 is triggered by the controller in order to initiate combustion of the fuel air mixture within second combustion chamber 32. If, for example, a spark initiator is used as ignition device 150, the controller can send an electrical current to the initiator in order to create a spark at the appropriate time. In general, the ignition device introduces sufficient energy into the fuel air mixture to form a flame front within second combustion chamber 32. As the flame front consumes the fuel by burning along with any oxidizers present within the mixture, the flame front will propagate along the second combustion flow path 130 toward first combustion chamber 31.

As the flame front propagates along second combustion flow path 130, the flame front will reach a plurality of obstacles 160. At this point, an interaction with the flame front with inner walls of second combustion chamber 32 and plurality of obstacles 160 will generate an increase in pressure and temperature within second combustion chamber 32. Such increased pressure and temperature tend to increase a speed at which the flame front propagates through second combustion chamber 32 and a rate at which energy is released from the fuel/air mixture by combustion at the flame front. This acceleration continues until the combustion speed rises above that expected from an ordinary deflagration process to a speed that characterizes a quasi-detonation or detonation. This detonation process takes place rapidly (in order to sustain a high cyclic rate of operation), so that obstacles 160 and 165 are used to decrease the run-up time and distance that is required for each initiated flame to transition into a detonation.

The flame front travels along first substantially linear portion 84 through curvilinear portion 86 into second substantially linear portion 88 and third substantially linear portion 89 encountering obstacles throughout obstacles 165. The flame front continues to accelerate along second and third substantially linear combustion portions 88 and 89 before exiting second end section 123. At this point, the flame front encounters deflection in surface 72 and is deflected back along first combustion chamber 31. The flame front continues to pass along first combustion flow path 63, through arcuate portion 36 and into vessel 2. The flame front and shock wave 27 associated therewith impact upon inner surfaces 7 of vessel 2 loosening any debris adhered thereon.

By guiding the flame front into deflection surface 72, combustion is bolstered and effectively transferred from a smaller diameter chamber, e.g. second combustion chamber 32, into a larger diameter chamber, e.g., first combustion chamber 31 thereby allowing the use of flexible fuels. That is, fuels having an associated large detonation cell size and high initiation energy. Thus, creating and/or maintaining a flame front with detonative or quasi-detonative speeds and associated shock wave along multiple combustion flow paths into a vessel is often times difficult. However, it has been found that by deflecting the flame front in such a manner sustains combustion and, by extension, the flame front and associated shock wave. Thus, the present invention enables the use of various flexible fuels heretofore not practical in use in existing detonation combustion cleaning systems, and is able to utilize such fuels in a much more compact cleaner geometry that presently available.

Figure 3:
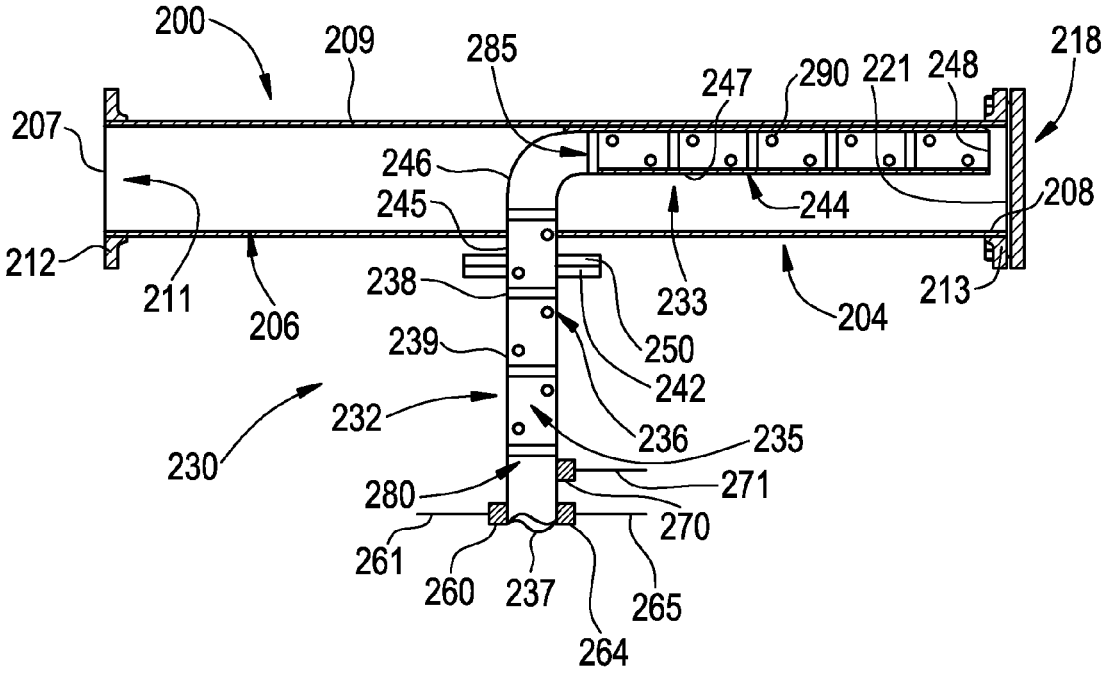
FIG. 3 is a cross-sectional schematic view of a detonation combustion cleaning device in accordance with another exemplary embodiment of the invention.

Reference will now be made to FIG. 3 in describing a detonation combustion cleaning device 200 constructed in accordance with another exemplary embodiment of the invention. As shown, detonation combustion cleaning device 200 includes a main or first combustion chamber 204 having a main body portion 206 including a first end portion 207 that extends to a second end portion 208 through a substantially linear intermediate portion 209. In a manner similar to that described above, main body portion 206 defines a first combustion flow path 211. In a manner also similar to that described above, first end portion 207 is provided with a flange 212 that is configured to couple with flange 10 on vessel 2 while second end portion 208 is provided with a flange 213. Flange 213 is coupled to a deflection member 218 having a deflection surface 221. Unlike the curvilinear deflection surface 72 described above, deflection surface 221 is substantially planar or linear.

Detonation and combustion cleaning device 200 also includes an initiator tube or second combustion chamber 230 having a first combustion section 232 that extends to a second combustion section 233 that define a second combustion flow path 235. As shown, first combustion section 232 includes a main body section 236 having a first end section 237 that extends to a second end section 238 through an intermediate section 239. Second end section 238 is provided with a flange 242 which, as will be described more fully below, joins first combustion section 232 to second combustion section 233. Towards that end, second combustion section 233 includes a main body section 244 having a first end section 245 that extends to a first intermediate or curvilinear or angled section 246 that passes to a second intermediate or substantially linear portion 247 before terminating in a second end section 248. First end section 245 is provided with a flange 250 that engages with flange 242 on first combustion section 232.

Second combustion chamber 230 includes an air inlet 260 provided at first end section 237 of first section 232. Air inlet 260 is configured to be fluidly connected to air source 23 via a conduit 261. A fuel inlet 264 is arranged adjacent to air inlet 260. Fuel inlet 264 is configured to be fluidly connected to fuel source 24 via a conduit 265. An igniter 270 is arranged downstream from air inlet 260 and fuel inlet 264. Igniter 270 is connected to a controller (not shown) through an igniter lead 271. In a manner similar to that described above, first combustion section 232 includes a first plurality of obstacles 280. Obstacles 280 serve to accelerate a flame front passing through second combustion chamber 230 along second combustion flow path 235. A second plurality of obstacles 285 are formed within second combustion section 233 and serve to further accelerate the flame front passing along second combustion flow path 235. Each of the plurality of obstacles 280, 285 are represented by cylindrical protrusions, one of which is indicated at 290, that extend off an inner wall portion (not separately labeled) of second combustion chamber 230.

As described above, igniter 270 initiates combustion of a fuel/air mixture present within second combustion chamber 230 creating a flame front having an associated shock wave. The flame front moves along second combustion flow path 235 before exiting second end of section 248 of second section 233. Upon exiting second section 233 the flame front impact deflection surface 221 is reflected or redirected back along first combustion flow path 215. The flame front and associated shock wave move along first combustion flow path 215 through first end portion 207 and exit into vessel 2 impacting upon inner surfaces to loosen debris there from. As noted above, by deflecting the flame front and associated shock wave, from a smaller combustion chamber to a larger combustion chamber, detonation combustion cleaning device 200 is configured to burn flexible fuels/mixtures such fuels containing methane/natural gas, propane, ethylene, hydrogen, acetylene, and many other gaseous or vaporize fuels. In essence, detonation combustion cleaning device 20 is configured to detonate fuels/mixtures having a large detonation cell and that require large detonation initiation energy without oxygen enrichment or the fuel/air mixture.

In general, this written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of exemplary embodiments of the present invention if they have structural elements that do not differ from the literal language of the claims, or if they include equivalent structural elements with insubstantial differences from the literal language of the claims.

The invention claimed is:

1. A detonation device cleaning system comprising:

a vessel having a main body including an outer surface and an inner surface that collectively define an interior chamber;

a detonation combustor cleaning device mounted to the vessel, the detonation combustor cleaning device comprising:

at least one combustion chamber that defines a combustion flow path, the at least one combustion chamber including a deflection member arranged along the combustion flow path; and an ignition device operatively connected to the at least one combustion chamber, the ignition device being selectively activated to ignite fuel within the at least one combustion chamber to produce a shockwave that moves in a first direction along the combustion flow path, is redirected back along the flow path within the at least one combustion chamber, and passes into the interior chamber to dislodge particles clinging to the inner surface of the vessel.

2. The detonation device cleaning system according to claim 1, wherein the deflection member includes a substantially planar deflection surface.

3. The detonation device cleaning system according to claim 1, wherein the deflection member includes a curvilinear deflection surface.

4. A detonation combustor cleaning device comprising:

at least one combustion chamber that defines a combustion flow path, the at least one combustion chamber including a deflection member; and an ignition device operatively connected to the at least one combustion chamber, the ignition device being selectively activated to ignite fuel within the at least one combustion chamber to produce a shockwave that moves in a first direction along the combustion flow path, is redirected back along the flow path within the at least one combustion chamber, and passes into the interior chamber to dislodge particles clinging to the inner surface of the vessel.

5. The detonation combustor cleaning device according to claim 4, wherein the at least one combustion chamber includes a first combustion chamber, the first combustion chamber having a main body portion defining a first combustion flow path, and a second combustion chamber fluidly connected to the first combustion chamber, the second combustion chamber having a main body section defining a second combustion flow path.

6. The detonation combustor cleaning device according to claim 5, wherein the main body section of the second combustion chamber extends through the main body portion of the first combustion chamber.

7. The detonation combustor cleaning device according to claim 6, wherein the main body portion includes an arcuate portion, the second combustion chamber passes through the arcuate portion and extends along the first combustion flow path.

8. The detonation combustor cleaning device according to claim 6, wherein the main body portion includes a substantially linear portion, the second combustion chamber passes through the substantially linear portion and extends through an angled section to a substantially linear section, the substantially linear section extends along the first combustion flow path and projects toward the deflection member.

9. The detonation combustor cleaning device according to claim 5, wherein the second combustion chamber includes a plurality of obstacles disposed along the second combustion flow path, the plurality of obstacles being arranged to promote an acceleration of the shockwave toward the deflection member.

10. The detonation combustor cleaning device according to claim 5, wherein the second combustion chamber includes a first combustion section, connected to a second combustion section through a curvilinear section that collectively define the second combustion flow path.

11. The detonation combustor cleaning device according to claim 4, wherein the deflection member includes a substantially planar deflection surface.

12. The detonation combustor cleaning device according to claim 4, wherein the deflection member includes a curvilinear deflection surface.

13. The detonation combustor cleaning device according to claim 12, wherein the curvilinear deflection surface is a concave surface.

14. A method of cleaning a vessel with a detonation cleaning device, the method comprising:

receiving a flow of air and fuel into at least one combustion chamber having a combustion flow path;

forming a shockwave within the combustion flow path through ignition of the air and fuel;

accelerating the shockwave along the combustion flow path in a first direction;

redirecting the shockwave within the combustion chamber back along the combustion flow path in a second direction;

directing the shockwave into a vessel having a surface to be cleaned; and loosening debris from the surface to be cleaned as a result of impacts from the shockwave.

15. The method of claim 14, wherein, redirecting the shock wave back along the combustion flow path includes guiding the shock wave into another combustion chamber having another combustion flow path.

16. The method of claim 15, wherein accelerating the shockwave along the combustion flow path in the first direction includes passing the shockwave substantially parallel relative to the another combustion flow path.

17. The method of claim 15, wherein accelerating the shockwave along the combustion flow path includes accelerating the shockwave within the another combustion chamber.

18. The method of claim 14, wherein redirecting the shockwave includes accelerating the shockwave into a deflection member having a substantially planar deflection surface.

19. The method of claim 14, wherein redirecting the shockwave includes accelerating the shockwave into a deflection member having a curvilinear deflection surface.

20. The method of claim 14, wherein redirecting the shockwave includes accelerating the shockwave into a deflection member having a concave deflection surface.

* * * * *